United States Patent [19]

Derr

[11] 4,030,766

[45] June 21, 1977

[54] GOLF CLUB WITH ALIGNING MEANS

[76] Inventor: Josiah F. Derr, 335 E. 2nd, Berwick, Pa. 18603

[22] Filed: July 8, 1976

[21] Appl. No.: 703,458

[52] U.S. Cl. ..... 273/163 R; 273/183 D

[51] Int. Cl.[2] ..... A63B 53/04; A63B 69/36

[58] Field of Search ..... 273/77 R, 162 R, 162 D, 273/162 F, 163 R, 164, 167 R, 167 D, 169, 171, 183 R, 183 D, 186 R, 186 A, 186 E, 193 R, 194 R, 194 A, 32 R, 32 A; 224/5 C, 25 R, 25 A, 29 B, 29 K

[56] References Cited

UNITED STATES PATENTS

| | | | |
|---|---|---|---|
| 1,739,780 | 12/1929 | Buhrke | 224/5 C X |
| 2,156,025 | 4/1939 | Paul | 224/29 B X |
| 3,220,733 | 11/1965 | Saleeby | 273/171 |
| 3,328,032 | 6/1967 | Griswold | 273/163 R X |
| 3,411,789 | 11/1968 | Wariner | 273/194 A X |
| 3,620,426 | 11/1971 | Hatch | 273/32 A X |
| 3,727,920 | 4/1973 | Scott | 273/194 A X |
| 3,877,745 | 4/1975 | Girard | 224/29 A X |
| D104,495 | 5/1937 | Gallagher | 273/164 X |
| D230,615 | 3/1974 | Delgadillo | 273/164 X |
| D241,563 | 9/1976 | McCord | 273/164 X |

*Primary Examiner*—Richard J. Apley

[57] ABSTRACT

A golf club is provided with an alignment device to assist the user in aligning the golf club with a golf ball. The alignment device comprises a housing member fastened to the club head. The housing member comprises a base portion and a pair of side walls integrally formed therewith and a pair of spaced apart front walls each integrally formed with the side walls and extending in a plane substantially parallel to the base portion for defining a chamber therebetween. The device further comprises an alignment element comprising a frame member adapted to extend between the side walls and within the chamber and a spherical section secured to the frame member and extending exteriorally of the chamber. The device further comprises restraining structure engageable with the alignment element and housing member to prevent removal of the alignment element when the golf club is in use.

10 Claims, 3 Drawing Figures

GOLF CLUB WITH ALIGNING MEANS

BACKGROUND OF THE INVENTION

The present invention relates to the art of golf clubs and more particularly to a gold club which includes means for facilitating the alignment of the club for stroking or hitting a golf ball.

In the art of golf numerous inventions have been proposed for golf clubs to provide alignment means by which the player can more accurately address a ball to be putted. However, as shown by the lack of significant adoption of these club constructions by the average golfer it could be said that the prior art arrangements are less than completely successful.

OBJECTS OF THE INVENTION

An object of the present invention is to provide means which may be used by the player to align the head with a ball to be putted, thus improving the player's game.

Another object of the present invention is to provide a golf club with an alignment arrangement which will hold the golfer's attention and will utilize the golfer's natural instinct to cause him to align the ball, club head, and target quickly and positively.

Another object of the present invention is to provide alignment means that may be interchangeable as to the desired weighting of the club head.

Other objects and advantages of the present invention will become obvious as the disclosure proceeds.

SUMMARY OF THE INVENTION

A golf club having a club shaft and a head with its face in a substantially vertical plane is provided with interchangeable alignment facilitating means on the club head that may be mounted on existing golf clubs. The alignment means includes housing means having a chamber contained therein and including a base portion, a pair of integrally formed side walls and a pair of spaced apart front walls each integrally formed with the side walls and extending in a plane substantially parallel to the base portion for defining the chamber. The alignment means is adapted to be received within the chamber in relatively fixed position with respect thereto. The alignment means includes a frame member adapted to extend between the side walls and within the chamber and a spherical section including a generally spherical surface having the same diameter of a golf ball when viewed from above defining essentially a hemispherical mass. Restraining means engageable with the alignment means and the housing means to prevent removal of the alignment means when the golf club is in use is also provided.

BRIEF DESCRIPTION OF THE DRAWINGS although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a front elevational view, partly in section, of the invention as applied to the head of golf club, FIG. 2 is a top elevational view showing the relationship between the various component parts of the invention; and FIG. 3 is an exploded view of the various component parts of the invention.

DETAILED DESCRIPTION OF THE PREFERRED EMBODIMENT

Figure 2:
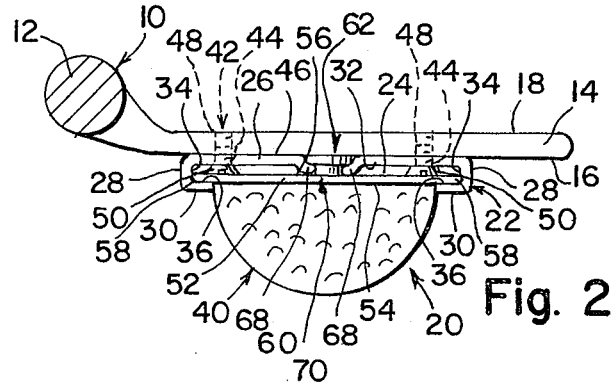
Figure 1:
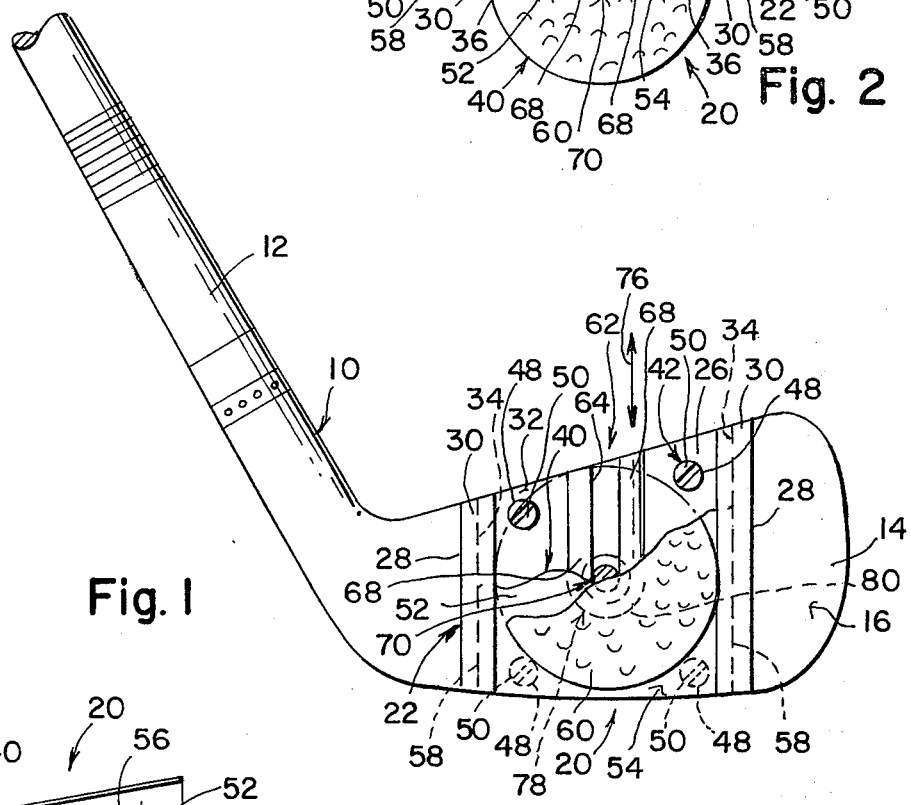
Figure 3:
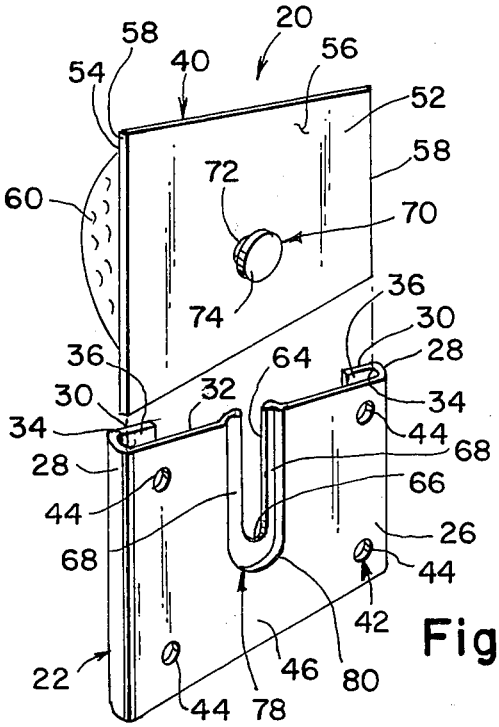

Referring to the drawings, FIGS. 1—3 illustrate the principles of this invention as applied to a golf club 10 that includes the usual club shaft 12 and club head 14 having a pair of substantially vertical faces 16 and 18 that are normally associated with the golf club 10. The ball sighting facilitating means 20 of the present invention includes housing means 22 having a chamber 24 contained therein and formed of a substantially flat base portion 26 having a pair of integrally formed side walls 28 that terminate in a pair of spaced apart front walls 30 that may be each integrally formed with the side walls 28 and extending in a plane substantially parallel to the base portion 26. The chamber 24 is defined by the inner wall surface 32 of the base portion 26, the inner wall surface 34 of the side walls 28 and the inner wall surface 36 of each of the front walls 30. The spacial relationship between these walls interrelates for receipt therein of the alignment means 40 as hereinafter explained.

Fastener means 42 is provided and may include a plurality of spaced apart apertures 44 that extend between the inner wall surface 32 and the outer or rear wall surface 46 of the base portion 26. Each aperture 44 may have a screw 48 extending therethrough and into the head 14 of golf club 10. The head 50 of each screw 48 may extend within the chamber 24.

The alignment means 40 is adapted to be received within the chamber 24 in relatively fixed position with respect thereto. The alignment means 40 includes a substantially rectangular frame member 52 having a front face 54 and rear face 56 and a width such that the spaced apart ends 58 extend within the inner wall surfaces 34 of the housing means 22. The alignment means 40 includes a generally spherical surface 60 that extends exteriorally of the chamber 24 and may be secured to the frame member 52 by an adhesive or in some other desired manner. The spherical surface 60 has the same diameter as a golf ball when viewed from above defining essentially a hemispherical mass and may also have the texture of a golf ball.

In order to retain the alignment means 40 in the position illustrated in FIGS. 1 and 2, restraining means 62 is provided to prevent removal of the alignment means 40 from the position illustrated when the golf club 10 is in use. The restraining means 62 includes a substantially vertically extending slot or groove 64 in the base portion 26 of the housing means 22. The slot 64 starts at the top of the housing means and terminates in a curved bottom 66. The base portion 26 further includes in surrounding relation to the groove 64 an inwardly defined recess formed by an inwardly extending pair of spaced apart lips 68 that extend within chamber 24. A locking head 70 extends from surface 56 of the frame member 52 and includes a neck portion 72 adapted to be received within the slot 64 and a head portion 74 that may be integrally formed therewith and adapted to be positioned on the outward surface 46 of the base portion 26 and confined within the recess formed by the lips 68.

In this manner as seen in FIG. 1 the alignment means 40 may easily be disassembled from the housing means 22 which itself may be easily removed from the head 14 of the golf club 10. The dimensional relationship of the neck 72 in comparison to the recess formed by lips 68 with respect to the head 74 and the interrelationship of frame member 52 is such that there is a yieldably urging force on the frame member 52 against the front inner walls 36 such that a force of predetermined magnitude has to be manually applied to the alignment means 40 to overcome the frictional engagement between the frame member 52 and lips 68. In addition the heads 50 of the screws 48 contained within the chamber 24 may also provide an additional frictional force. By providing the lips 68 to be formed of resilient material it is possible to obtain sufficient frictional engagement between the overlapping abuttng surfaces to require the manually applied force.

When the user inserts or removes the alignment means 40 in the directions indicated by double-headed arrow 76, means have to be provided to limit the downward travel of the alignment means 40. Towards this end stop means 78 is provided and may take the form of the curved bottom 66 of the slot 64 as well as the curved bottom 80 defined at the bottom of the base portion 26 when the lips 68 are formed. The curved bottom 80 or curved bottom 66 may be dimensioned and adapted to receive therein and abut the neck portion 72 or the head portion 74 to limit the downward travel of the alignment means 40.

Accordingly, the embodiment described herein permits the user to utilize a variety of interchangeable alignment means that may be quickly and easily clipped in and out of its mounted relationship with a golf club without the use of any tools once the housing means has been secured thereto. In this way, if the spherical portion were to be changed as to size or color, the golfer need only clip in a different alignment head.

Although an illustrative embodiment of the invention has been described in detail herein with reference to the accompanying drawings, it is to be understood that the invention is not limited to the precise embodiment, and that various changes and modifications may be effectd therein without departing from the scope or spirit of the invention.

I claim:

1. In a golf club having a club shaft and a head with its face in substantially vertical plane, A. housing means having a chamber contained therein and including a base portion, a pair of side walls integrally formed with said base portion and a pair of spaced apart front walls each integrally formed with said side walls and extending in a plane substantially parallel to said base portion for defining said chamber, B. fastener means extending through said base portion for securing said housing means to the golf club head, C. alignment means adapted to be received within said chamber in relatively fixed position with respect thereto, said alignment means including a frame member adapted to extend between said side walls and within said chamber and a spherical section secured to said frame member extending exteriorally of said chamber and including a generally spherical surface having the same diameter of a golf ball and when viewed from above definding essentially a hemispherical mass, and D. restraining means engageable with said alignment means and said housing means to prevent removal of said alignment means when the golf club is in use.

2. In a golf club as defined in claim 1, wherein said restraining means includes:

a. a substantially vertically extending slot on said base portion, b. an inwardly extending pair of spaced apart lips extending inwardly into said chamber, and c. a locking head outwardly extending from the rear of said frame member and including:

i. a neck portion adapted to be received within said slot, and ii. a head portion adapted to be positioned on the outward surface of the base portion to prevent movement between said housing means and alignment means during use of the golf club.

3. In a golf club as defined in claim 2, wherein said restraining means yieldably urges said frame member against the front walls of said housing means such that a force of predetermined magnitude has to manually applied to said alignment means to overcome the frictional engagement between said frame member and lips to permit movement of the latter.

4. In a golf club as defined in claim 3, wherein said spaced apart lips are formed of resilient material to act as said restraining means exhibiting sufficient force to retain the alignment means within the chamber without any additonal means.

5. In a golf club as defined in claim 2, wherein said fastener means includes a plurality of spaced apart apertures in said base portion.

6. In a golf club as defined in claim 2, and further including stop means associated with said housing means for limiting the travel of the alignment means relative to the housing means for proper positionment of said alignment means with respect to the head of the golf club.

7. In a golf club as defined in claim 6, wherein said stop means includes a depression having a curved bottom that is adapted to receive therein said head or neck portion such that the downward travel of the alignment means is limited.

8. In a golf club as defined in claim 1, a. wherein said restraining means includes:

1. a substantially vertically extending slot on said base portion, 2. an inwardly extending pair of spaced apart lips extending inwardly into said chamber, and 3. a locking head outwardly extending from the rear of said frame member and including:

i. a neck portion adapted to be received within said slot, and ii. a head portion adapted to be positioned on the outward surface of the base portion to prevent movement between said housing means and alignment means during use of the golf club, b. wherein said restraining means yieldably urges said frame member against the front walls of said housing means such that a force of predetermined magnitude has to be manually applied to said alignment means to overcome the frictional engagement between said frame member and lips to permit movement of the latter, said spaced apart lips are formed of resilient material to act as said restraining means exhibiting sufficient force to retain the alignment means within the chamber without any additional means, and c. further including stop means associated with said housing means for limiting the travel of the alignment means relative to the housing means for proper positionment of said alignment means with respect to the head of the golf club.

9. In a golf club as defined in claim 8, wherein said stop means includes a depression having a curved bottom that is adapted to receive therein said head or neck portion such that the downward travel of the alignment means is limited.

10. In a golf club as defined in claim 8, wherein said fastener means includes a plurality of spaced apart apertures in said base portion, and the heads of the screws extend within the chamber for providing additional frictional forces on each side of said locking head.

* * * * *